US005410841A

United States Patent [19]

Harris et al.

[11] Patent Number: 5,410,841

[45] Date of Patent: May 2, 1995

[54] SLIDING DOOR AND WINDOW SECURITY MEANS

[76] Inventors: Patrick W. Harris; Maureen A. Harris, both of 15 Woodland Crescent, North Buderim, Queensland, 4556, Australia

[21] Appl. No.: 228,515

[22] Filed: Apr. 15, 1994

[51] Int. Cl.[6] ..... E05B 65/04

[52] U.S. Cl. ..... 49/67; 49/56; 49/141

[58] Field of Search ..... 49/67, 61, 141, 56, 49/50, 63

[56] References Cited

U.S. PATENT DOCUMENTS

| | | | |
|---|---|---|---|
| 2,924,862 | 2/1960 | Pellicore | 49/67 X |
| 4,409,757 | 10/1983 | Daugherty | 49/63 X |
| 4,484,410 | 11/1984 | English | 49/63 |
| 4,575,965 | 3/1986 | Iversen | 49/50 |
| 4,630,396 | 12/1986 | Zvi et al. | 49/56 X |
| 5,020,834 | 6/1991 | Zilkha | 49/56 X |

*Primary Examiner*—Philip C. Kannan

*Attorney, Agent, or Firm*—Abelman, Frayne & Schwab

[57] ABSTRACT

The invention provides a security panel release mechanism for a sliding door or window assembly of the type having a pane movable in a frame to an open attitude in which its free edge is spaced from the frame member with which it engages when closed, the opening so exposed being secured by a security panel; characterized in that (1) the security panel is so mounted that it is movable between a closed position in which it is effective to prevent access to the opening and an open position in which the opening is available as an emergency exit, (2) the security panel is normally held in the closed position by lock means retaining the security panel adjacent the pane frame, and (3) the pane is fitted with lock release means normally ineffective so that the pane opening and closing functions are available, but adapted to be rendered operative in an emergency whereby sliding movement of the pane causes its lock release means to render the security panel lock means inoperative to free the security panel for movement to its open position.

11 Claims, 4 Drawing Sheets

SLIDING DOOR AND WINDOW SECURITY MEANS

FIELD OF INVENTION

THIS INVENTION relates to door and window security means, and it is particularly concerned with emergency escape mechanisms for doors and windows having security panels fitted so as normally to prevent unauthorized access. Since the invention is especially applicable to sliding doors and windows, it will be described herein in relation to such doors and windows.

BACKGROUND OF THE INVENTION

To an ever-increasing extent, houses, flats, home units and other buildings are being fitted with security grilles or panels over all or part of window and door openings so that ventilation is achieved and insects excluded by the provision of mesh, but without burglars or other intruders being able to enter. Such security panels may not be strictly necessary for some openings which are high or otherwise not easily accessible, but they are considered almost essential for window and door openings at lower levels such as ground or first floors. Unfortunately, the abovementioned benefits can be offset in the minds of ill, elderly disabled or feeble occupants by the disadvantage of knowing that the security panels also prevent escape in emergency circumstances such as in the event of a fire which might be so located as to prevent adults or children from reaching an "unbarred" access opening.

SUMMARY OF THE INVENTION

It will therefore be apparent that there is a need for door and window security means which will enable the normal benefits to be enjoyed but which can be rendered inoperative in emergency situations to permit the opening to be used as an emergency escape route.

Accordingly, it is the principal object of the present invention to provide a novel and efficient system or mechanism whereby the security advantages will be achieved but the opening may be made available for escape purposes when necessary.

Another object of the invention is to provide such an escape mechanism which will not detract from the normal appearance or be aesthetically unattractive, and which will be totally efficient and reliable without being unduly expensive. Yet another object is to provide such a release mechanism which will not normally render the opening unsafe accidentally, as would be worrying in relation to the safety of children. Other objects and advantages of the invention will become clearer from the descriptions herein.

With the foregoing and other objects in view, our invention resides broadly in a security panel release mechanism for a sliding door or window assembly of the type having a pane movable in a frame to an open attitude in which its free edge is spaced from the frame member with which it engages when closed, the opening so exposed being secured by a security panel; characterized in that (1) the security panel is so mounted that it is movable between a closed position in which it is effective to prevent access to the opening and an open position in which the opening is available as an emergency exit, (2) the security panel is normally held in the closed position by lock means retaining the security panel adjacent the frame, and (3) the pane is fitted with lock release means normally ineffective so that the pane opening and closing functions are available, but adapted to be rendered operative in an emergency whereby sliding movement of the pane causes its lock release means to render the security panel lock means inoperative to free the security panel for movement to its open position.

In a preferred practical embodiment of the invention, the security panel is hingedly mounted about a vertical axis on its edge remote from the free edge of the pane, the opposite edge of the security panel having a plurality of lock members adapted to engage normally in lock apertures associated with the frame, the pane having release means operable in an emergency situation to permit such sliding of the pane as will free the lock members from the lock apertures.

Preferably, the lock members each comprise a lock pin with a transverse slot adapted to engage an edge of a movable locking plate inside the frame when the lock pin is in operative association with the lock aperture, the edge of the locking plate being movable under the urging of the release means to disengage the slot.

Suitably, the release means comprise a release pin mounted adjacent the free edge of the pane and adapted to engage release apertures associated with the frame when the lock release means are rendered operative. The release pin when so engaged abuts the movable locking plate causing it to move. Preferably the movement of the locking plate is a pivotal motion causing the edge of the locking plate to slide out of the slot. The edge of the locking plate referred to above is generally the bottom edge of a rounded aperture in a side of the locking plate that is set at 90° to the side which the release pin abuts.

Suitably, the release means on the pane will normally be inoperable under the action of a safety catch which is not normally accessible to children, but an adult or instructed child may release the safety catch, whereupon the pane is permitted additional opening travel which renders the release means operable.

Preferably, the safety catch is mounted on the frame and includes a detent which prevents further sliding movement of the pane when a catch member movably mounted on the pane abuts the detent. Suitably, the catch member is mounted on the pane so that with simultaneous manual movement of the catch member to avoid the detent and a continuation of the sliding movement of the pane, the pane is permitted additional travel. Typically, the safety catch is mounted extending down from the top frame adjacent, but spaced from, the end of the frame and the catch member is mounted on the top of the pane at the end of the frame. The catch member is then slid vertically down a post on which it is slidably mounted against a spring, to avoid the detent. The safety catch may have a recess formed therein in which case a corresponding projection on the catch member can be received therein if the catch member is maneuvered to a position only part of the way past the safety catch and then released. This serves to lock the pane in an almost fully open position but does not allow the additional travel.

Alternatively, the lock members are operatively connected, for example by connecting rods joining the respective locking plates, and can be released by operating a handle of the like which initiates a lifting motion of each locking plate simultaneously to release all of the locking pins. The lock members can be operatively connected so as to be out of register so that it would be necessary to pick all of the locks simultaneously to open the security panel.

Other features of the invention including refinements for the sake of efficiency and tamper proofing will be hereinafter apparent.

BRIEF DESCRIPTION OF THE DRAWINGS

In order that the invention may be more readily understood and put into practical effect, reference will now be made to the accompanying drawings, wherein.

DETAILED DESCRIPTION OF PREFERRED EMBODIMENTS

Figure 1:
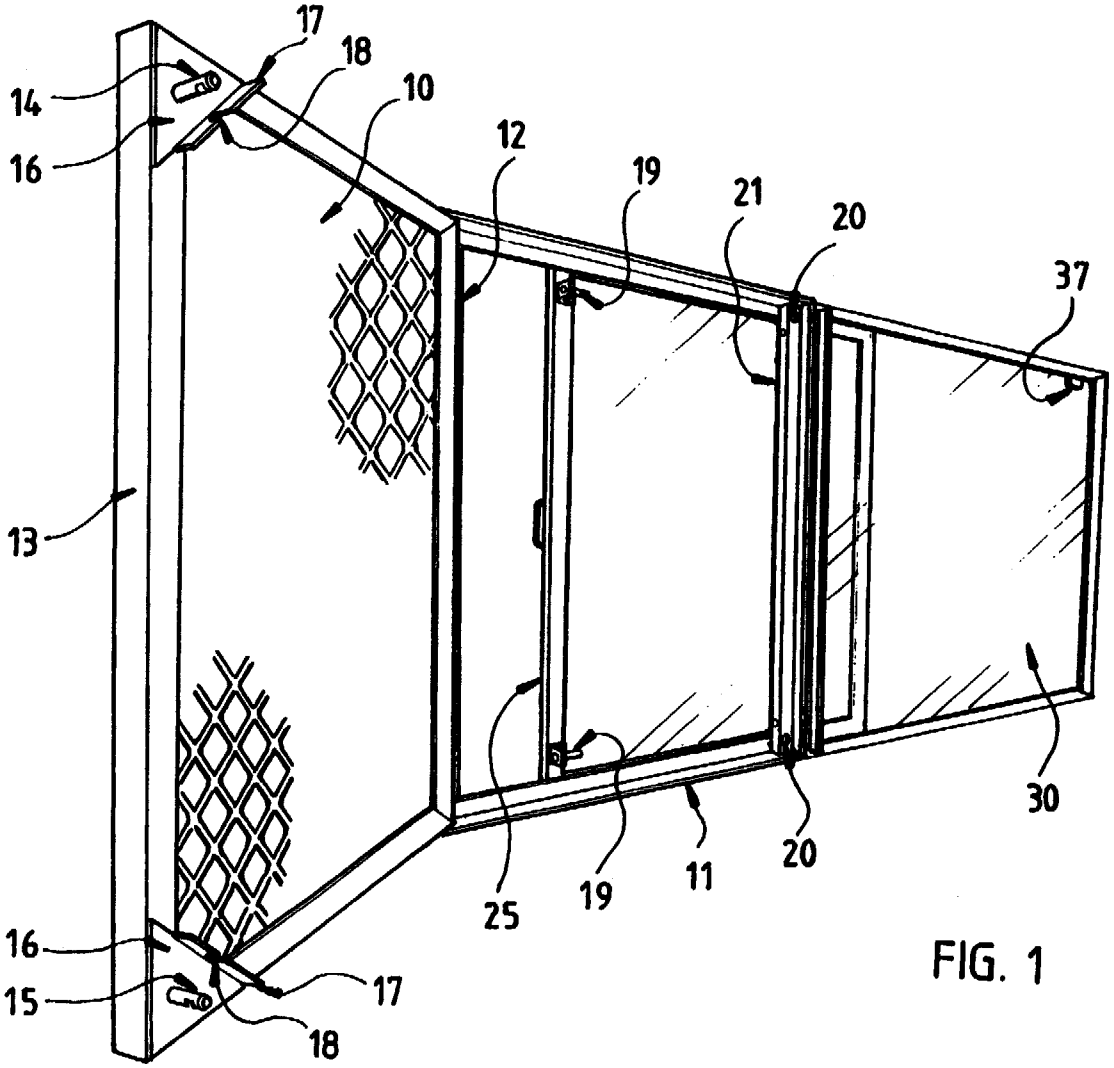
FIG. 1 shows a sliding window assembly in accordance with the invention.

Referring now to FIG. 1, it can be seen that the security grille or panel 10 is of standard rectangular form and is hinged to frame or sash 11 about a vertical axis 12, its opposite free frame member 13 having corner locking pins 14 and 15 at top and bottom on gusset plates 16. The gusset plates 16 also carry anti-pilfer plates 17 having openings 18 through which release pins 19 may enter as later described. The security panel 10 is shown in the open position and the window is shown partially open, the sliding window pane 25 having been moved back towards the closed position from the security panel release position as later described. The fixed window pane 30 is also shown and in this connection it should be noted that the term "pane" refers to the frame surrounding the sheet of glass as well as to the sheet of glass.

Figure 3:
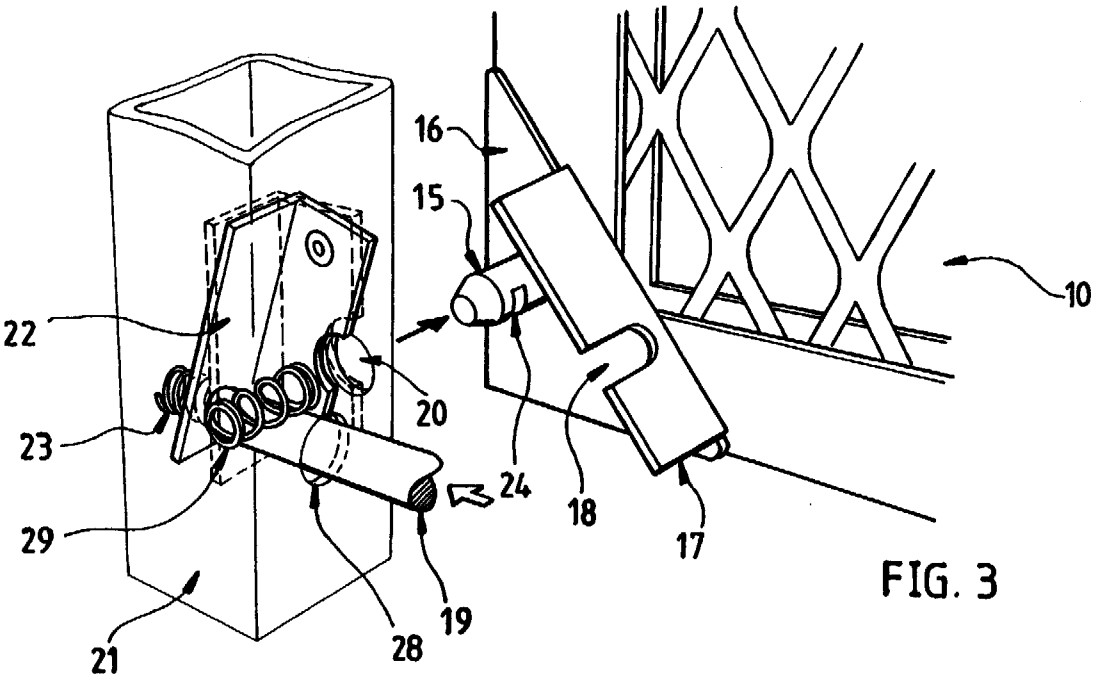
FIG. 3 shows in more detail the locking arrangement illustrated in FIG. 1 which secures the security panel to the window.
Figure 2:
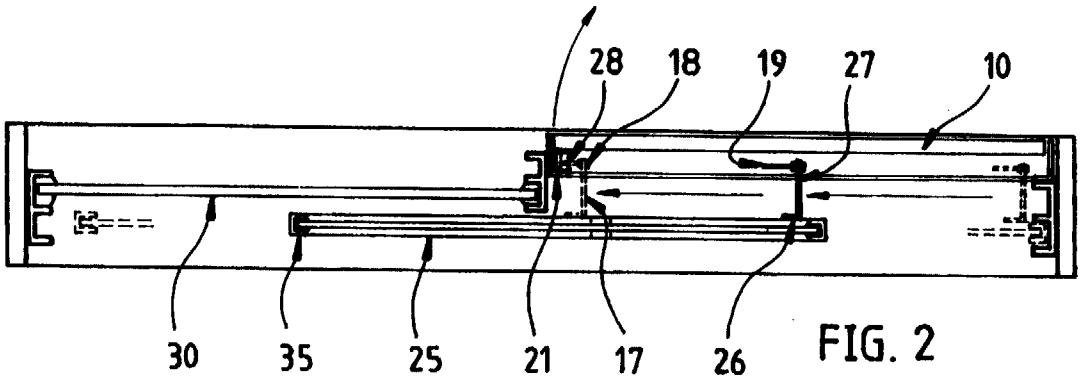
FIG. 2 is a horizontal section through the assembly shown in FIG. 1 but with the security panel shown in the closed position.

The opening of the security panel 10 will now be described with reference to FIGS. 2 and 3. Release pin 19 is shown in FIG. 2 secured to arm 27 of release bracket 26 which is fixed to the sliding pane 25, being secured by rivets or by long-term adhesive. Once the sliding window 25 reaches its most open position where the safety catch is released, as described later with reference to FIG. 4, release pin 19 will enter opening 28 in the hollow bar 21 and cause pivoting in a release action of the pivoted locking plate 22 against the action of spring 23. When the locking pin 15 is released (as shown), it will be forced outwards under the action of spring 29 resulting in opening of the security grille or panel 10. In the absence of urging by the release pin 19 the locking pins 14 and 15 lock in apertures 20 in the hollow bar 21, the pivoted locking plate 22 being urged by spring 23 to engage slot 24 in the locking pin 15 to retain a locked attitude. It can also be more clearly seen in FIGS. 2 and 3 how the release pin 19 passes through opening 18 in the anti-pilfer plate (when the panel 10 is closed) to reach opening 28.

Figure 4:
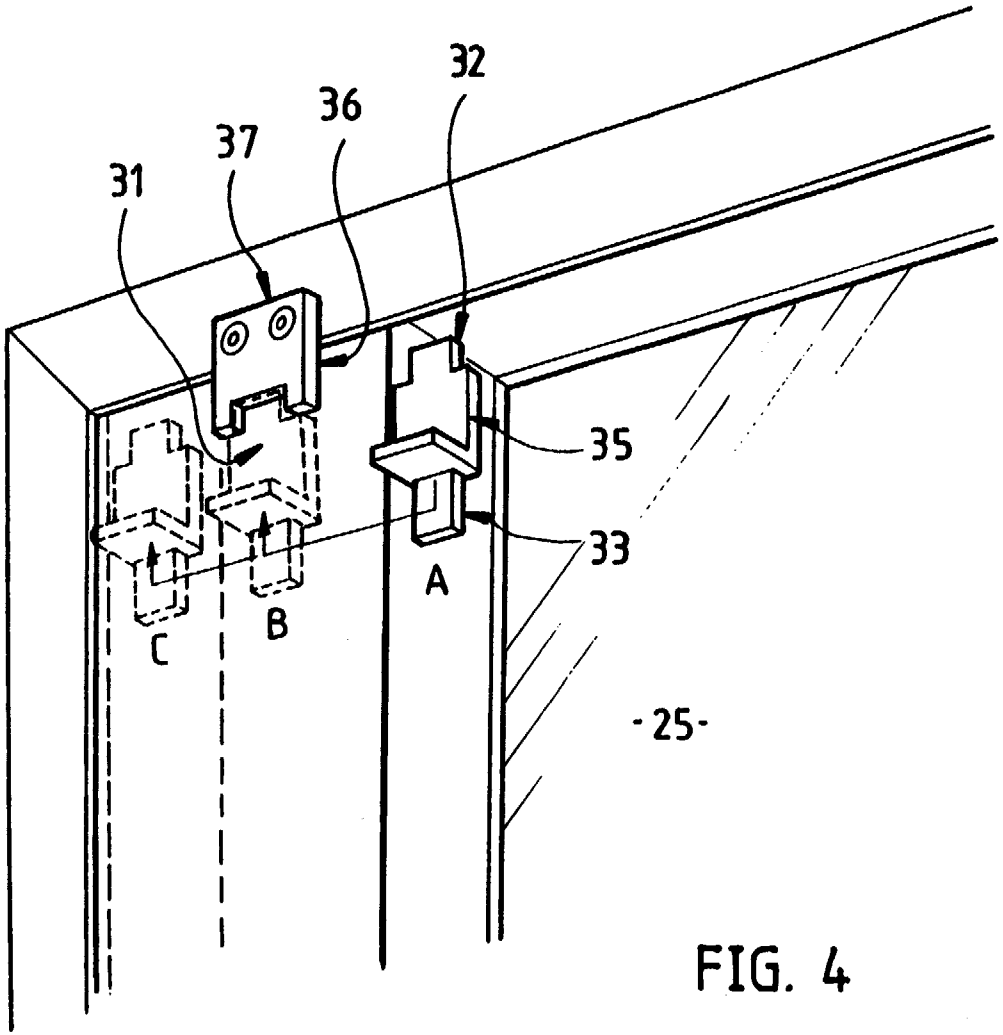
FIG. 4 shows in more detail the safety catch arrangement illustrated in FIG. 1.

Referring now to FIG. 4, the sliding pane 25 has a catch member 35 which ordinarily engages a detent 36 on safety catch plate 37 mounted on the frame as the window is moved toward its most open position, and this prevents the window being fully opened. The catch member 35 is, however, movable in the vertical direction up and down post 33 as shown by the representation thereof in phantom in position B and thus can be pulled down sufficiently to avoid detent 36. When the catch member is in this configuration the pane 25 is allowed additional travel and can be moved either to position B where the projection 32 on the catch member will engage the recess 31 in the safety catch plate 37 which will result in the window being held in the almost fully open position, or to position C where the window can be slid to the fully open position. The latter will of course result in opening of the security panel 10. The pane 25 could then be slid back to a partially closed position, for example so that its outside surface can be cleaned, whereupon the configuration shown in FIG. 1 will be achieved.

Figure 5:
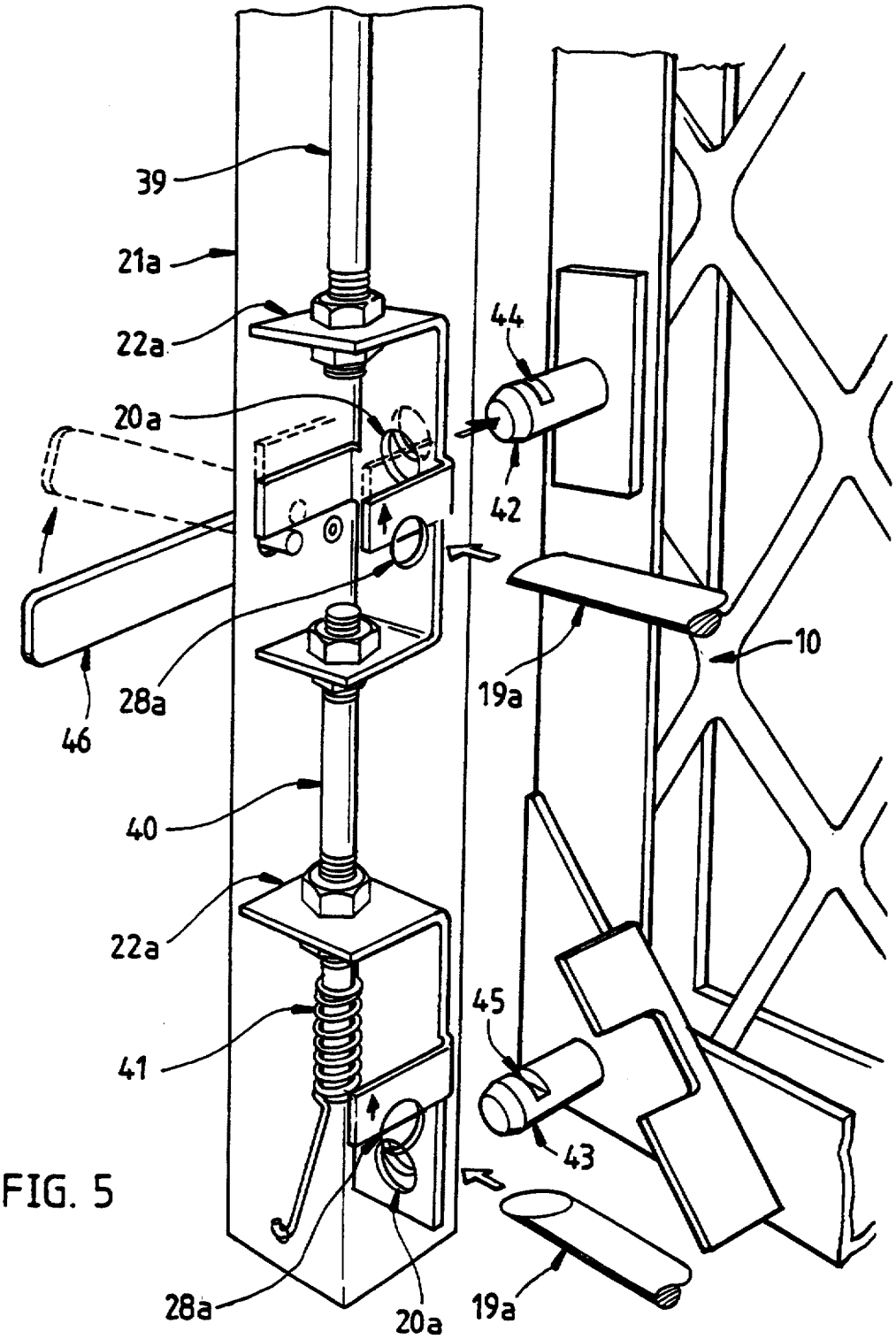
FIG. 5 illustrates an alternative locking arrangement.

FIG. 5 shows an alternative form of the invention in which the hollow bar **21*a* has apertures 20*a* to receive the locking pins 42, 43 and apertures for receiving the release pins 19*a* as well as locking plates 22*a* which are joined by connecting rods 39, 40. The handle 46 can be operated to lift the plate 22*a* to which it is attached and thence all of the other locking plates via connecting rods 39, 40. The plates 22*a* are then brought out of engagement with slots 44, 45 and the locking pins 42, 43 are released from the apertures 20*a* with the result that the security panel is released. The release pins 19*a* can then enter 28*a* to hold the locking plates in the released position against the urging of return spring 41 or can themselves release the panel 10 as described above. The locking plates 22*a* can be connected in such a way as to be "out of register" relative to the release pins 19*a*** so that one of the latter is adjusted ahead of the other. Whereas a burglar might insert an appropriate tool to pick the lock mechanism at one of the locking pins, it would require undue mental and physical athleticism to pick two at once when not in register. It would also be simple and beneficial to fit an alarm mechanism to give audible or other warning when the security grille has been rendered inoperative.

While apparatus as described and illustrated will therefore be found very effective in achieving the objects for which the invention has been devised, it will be apparent that these embodiments are illustrative only and may be subject to further modifications of detail and design. The invention will be useful in many applications, particularly for secured windows in hospitals and the like in addition to domestic situations. Also the security grilles need not be hinged about fixed axes since they could be designed to slide or otherwise move between operative and released conditions. As well as the stated benefits, it is also possible to use the invention to assist window cleaning on the outside of the panes where normally hampered by the security grille. The specification is naturally addressed to persons skilled in the art who will appreciate the various modifications which all reside within the broad scope and ambit of the invention, as defined by the appended claims.

What is claimed is:

1. A security panel release mechanism for a sliding door or window assembly of the type having a pane movable in a frame to an open attitude in which its free edge is spaced from the frame member with which it engages when closed, the opening so exposed being secured by a security panel; characterized in that (1) the security panel is so mounted that it is movable between a closed position in which it is effective to prevent access to the opening and an open position in which the opening is available as an emergency exit, (2) the security panel is normally held in the closed position by lock means retaining the security panel adjacent the pane frame, and (3) the pane is fitted with lock release means normally ineffective so that the pane opening and closing functions are available, but adapted to be rendered operative in an emergency whereby sliding movement of the pane causes its lock release means to render the security panel lock means inoperative to free the security panel for movement to its open position.

2. A security panel release mechanism according to claim 1, wherein the security panel is hingedly mounted about a vertical axis on its edge remote from the free edge of the pane, the opposite edge of the security panel having a plurality of lock members adapted to engage normally in lock apertures associated with the frame, the pane having release means operable in an emergency situation to permit such sliding of the pane as will free the lock members from the lock apertures.

3. A security panel release mechanism according to claim 2, wherein the lock members each comprise a lock pin having a transverse slot which is adapted to engage an edge of a movable locking plate inside the frame when the lock pin is in operative association with the lock aperture, the locking plate being movable under the urging of the release means so that its edge disengages the slot.

4. A security panel release mechanism according to claim 3, wherein the release means for each lock member comprises a release pin mounted adjacent the free edge of the pane and adapted to engage a release aperture associated with the frame, the release pin when so engaged abutting the movable locking plate whereby sliding movement of the pane causes the locking plate to move.

5. A security panel release mechanism according to claim 4, wherein the movement of the locking plate is a pivotal motion.

6. A security panel release mechanism according to claim 3, wherein the lock members are in operative connection.

7. A security panel release mechanism according to claim 6, wherein the lock members are connected so as to be out of register.

8. A security panel release mechanism according to claim 6, wherein the lock members are connected by connecting rods extending between the respective locking plates and all of the lock members are releasable by operation of a handle to initiate movement of the locking plates.

9. A security panel release mechanism according to claim 8, wherein the movement of the locking plates is a lifting motion.

10. A security panel release mechanism according to claim 1, wherein the release means on the pane is normally inoperable under the action of a safety catch, but upon release of the safety catch the pane is permitted additional opening travel which renders the release means operable.

11. A security panel release mechanism according to claim 10, wherein the safety catch is mounted on the frame and includes a detent which prevents further sliding movement of the pane when a catch member mounted on the pane abuts the detent, the catch member being movably mounted so that manual movement of the catch member to avoid the detent permits the additional opening travel.

* * * * *